United States Patent [19]

Keller et al.

[11] 4,387,486

[45] Jun. 14, 1983

[54] CONTROL SYSTEM FOR FIBER PROCESSING APPARATUS

[75] Inventors: Alex J. Keller, Clover, S.C.; Joseph R. Williams, Kings Mountain, N.C.; Erhard A. Fechner, Gastonia, N.C.; Akiva Pinto, Gastonia, N.C.

[73] Assignee: Automatic Material Handling, Inc., Bessemer City, N.C.

[21] Appl. No.: 283,828

[22] Filed: Jul. 16, 1981

Related U.S. Application Data

[63] Continuation-in-part of Ser. No. 255,109, Apr. 17, 1981, abandoned.

[51] Int. Cl.[3] ..... D01H 5/38

[52] U.S. Cl. ..... 19/105; 19/106 R; 19/240; 19/300

[58] Field of Search ..... 19/105, 240, 300, 106 R

[56] References Cited

U.S. PATENT DOCUMENTS

| | | | |
|---|---|---|---|
| 3,414,330 | 12/1968 | Trutzschler . | |
| 3,562,866 | 2/1971 | Roberson et al. | 19/105 |
| 3,728,759 | 4/1973 | Hergeth | 19/105 |
| 3,750,235 | 8/1973 | Wise | 19/105 |
| 3,903,570 | 9/1975 | Rowe | 19/300 X |
| 4,009,803 | 3/1977 | Lytton et al. | 19/105 |
| 4,161,052 | 7/1979 | Erben | 19/105 |
| 4,199,843 | 4/1980 | Leifeld et al. | 19/240 |
| 4,206,823 | 6/1980 | Krull | 19/240 X |
| 4,240,180 | 12/1980 | Wood et al. | 19/105 |
| 4,271,565 | 6/1981 | Grunder | 19/240 |
| 4,272,868 | 6/1981 | Grunder et al. | 19/105 X |
| 4,280,251 | 7/1981 | Ludwig | 19/105 |
| 4,321,732 | 3/1982 | Erben | 19/240 |
| 4,353,148 | 10/1982 | Beneke | 19/105 |

*Primary Examiner*—Louis Rimrodt

*Attorney, Agent, or Firm*—Richards, Shefte & Pinckney

[57] ABSTRACT

A control system for use in textile processing equipment including a card and a chute feed delivering a batt of fiber thereto. The operating speed of the card is sensed to generate a signal that is used to drive the motor for the oscillating densification plate and the feed roll of the chute feed at speeds having a predetermined ratio of the operating speed of the card. The weight of the batt formed by the chute feed is sensed and a signal is generated in proportion to the sensed weight, and this signal is used to override the primary drive for the oscillating plate and thereby vary the ratio between the operating speed of the card and speed of oscillation of the plate. The chute feed includes a device for sensing the level of accumulated fiber in the chute feed, and this device generates a signal that is utilized to override the primary drive for the feed roll of the chute feed and thereby vary the ratio between the operating speed of the card and the speed of such feed roll. In another embodiment, the "on-off" operating condition of the card is sensed, and the feed roll and oscillating plate are operated at a predetermined speed in response to the "on" condition of the card being sensed. The signal generated by the batt-weight sensing means is then used to vary the predetermined speeds of the feed roll and the oscillating plate.

16 Claims, 5 Drawing Figures

FIG. 1
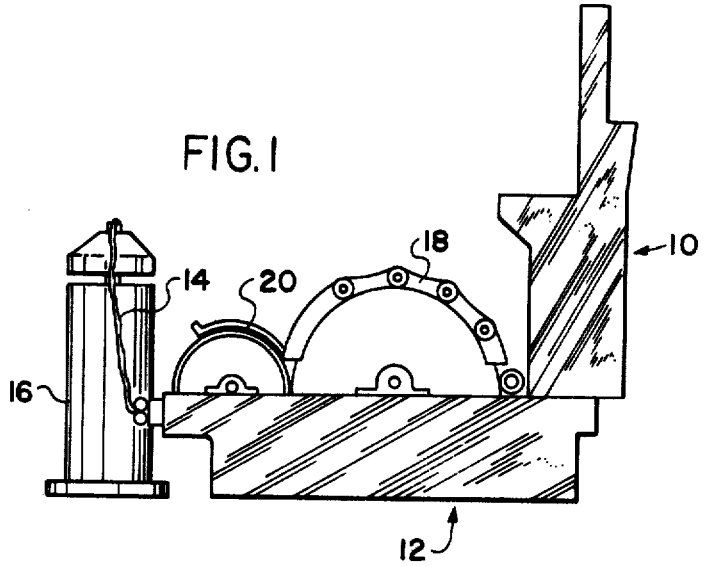
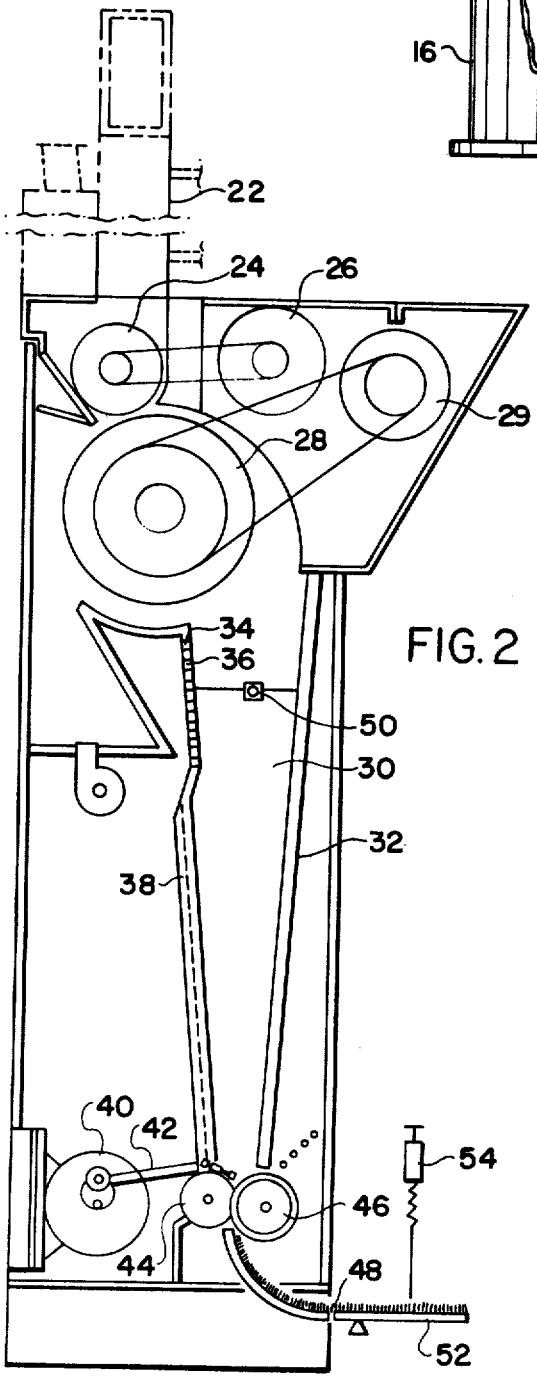
FIG. 2

FIG. 3
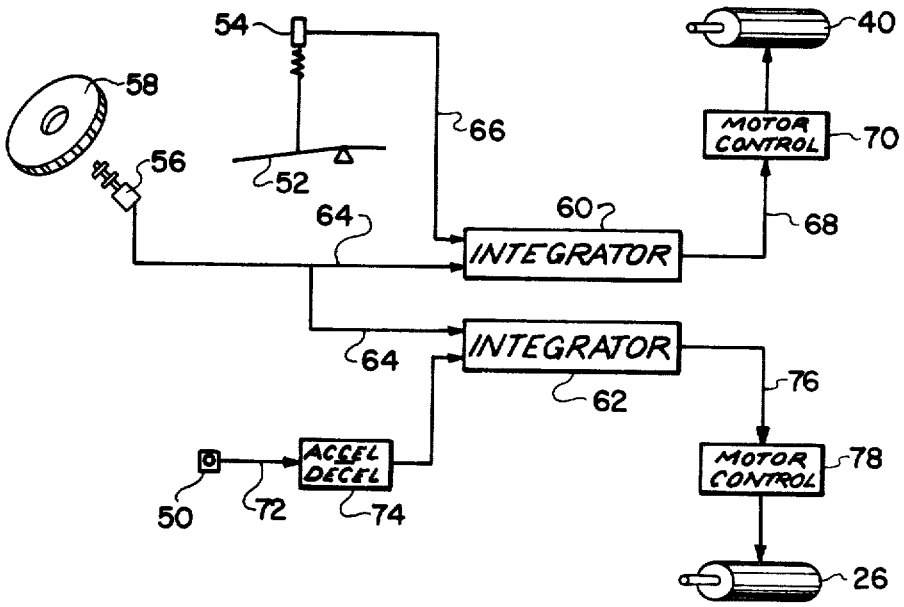
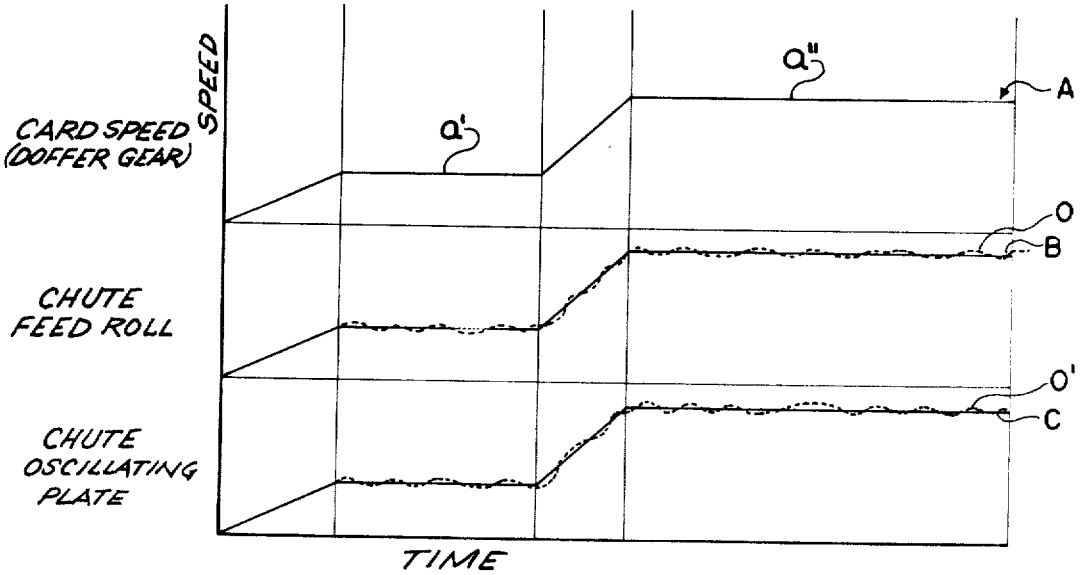
FIG. 4

CONTROL SYSTEM FOR FIBER PROCESSING APPARATUS

RELATION TO OTHER APPLICATIONS

This is a continuation-in-part application of U.S. patent application Ser. No. 255,109, filed Apr. 17, 1981, and now abandoned.

BACKGROUND OF THE INVENTION

Textile carding systems generally include a fiber feeding device, such as a chute feed, which accumulates a quantity of fiber and forms such fiber into a batt that is delivered to a card which separates the fibers into their individual elements, cleans the fiber, and forms the fiber into a sliver for use in the next step in the textile processing of the fiber. The card includes three basic components, namely an input feed roller which receives the aforesaid batt, a main carding cylinder which works the fiber, and a doffer which removes the fiber from the main cylinder and delivers the fiber through a trumpet or the like in sliver form. Traditionally, the doffer and the input feed roller were driven together through a mechanical driver arrangement that assured a constant speed ratio between the input feed roller and the doffer.

However, in an effort to improve sliver uniformity and reduce yarn count variation caused by insufficient control of the batt delivered to the card, autoleveling has largely replaced the aforesaid traditional direct, mechanical drive between the doffer and the input feed roller. Autoleveling may take a variety of forms, but it typically includes a variable speed transmission, such as an electrical drive system which results in the doffer and the input feed roller being driven at a predetermined speed ratio, and which also permits this ratio to be varied in response to variations in the density of the sliver leaving the doffer so as to provide a more uniform sliver.

The advantages of autoleveling are well known in the trade insofar as improved sliver characteristics are concerned, but known autoleveling systems nevertheless have some recognized disadvantages. For example, in autoleveling systems which sense the density of the sliver leaving the trumpet and then adjusts the speed of the input feed roll, it is apparent that the compensating effect caused by adjusting the input feed roll is imposed at one end of the card in response to a sensed density variation occurring at the other end of the card. As a result, the correcting speed change imposed on the input feed roll will have no compensating effect on the substantial length (e.g. 100 yards) of fiber which is being processed between the ends thereof by the main cylinder so that density variations in this intermediate length of fiber will not be corrected before such fiber leaves the card. Likewise, because the density sensing occurs at a location substantially downstream of the point where the compensating speed change is made, it may well be that the density variation at the sensing location will have already been partially or fully corrected in the fiber at the input feed roll when that portion of the sensed fiber reaches the trumpet so that the compensating speed change may cause an undesirable change in the density of the fiber rather than a correcting change.

Additionally, most conventional autoleveler equipment utilizes an air stream to sense the density of the sliver, but the fineness of the fiber in the sliver may cause variation in the air flow therethrough which are not directly attributable to fiber density, and this flow variation may adversely affect the accuracy of the sensing apparatus which, in turn, may adversely affect the compensating speed change imposed on the input feed roll of the card. Moreover, the use of air has inherent drawbacks, such as dirt entrained in the air stream and the fact that the humidity of the air may affect the accuracy of the density sensing apparatus, and it is therefore usually necessary to provide relatively expensive equipment to insure that the air is dry and clean as well as to provide relatively frequent maintenance for such equipment.

Another known method of autoleveling is described in Krull U.S. Pat. No. 4,206,823 and provides an arrangement for feeding the batt through a pair of compressor rolls as it leaves the fiber feeding apparatus and then weighing the batt by a sensitive load beam transducer that provides a signal which is processed through a central processing unit to regulate the speed of the feed rolls of the card and the compressor rolls. However, the speed change imposed on the feed rolls of the card also changes the proportional speed relatively between the doffer roll of the card and the feed rolls, whereby there may be an undesirable and adverse effect on the parallelization and drafting of the fiber during the carding of such fiber.

Finally, it is also known that more effective control of the batt leaving the fiber feeding apparatus may be obtained by controlling the operation of the opening roller in the fiber feeding apparatus in response to the level of the fiber accumulated in the fiber feeding apparatus. The opening roller is directly driven by a motor, and an electric eye is used to sense the level of the accumulated fiber and generate a signal which is applied to either vary the speed of or start and stop, the opening roller motor whereby more or less fiber is fed into the fiber feeding apparatus. In apparatus of this type, the opening roller motor is operated entirely independently of the card, and variations in the card speed (e.g. slow speed during start up, or the on-off condition of the card) may not reflect in the operation of the opening roll of the fiber feeding apparatus so that the density of the batt leaving the fiber feeding apparatus may not be attuned to the operation of the card to which the batt is delivered.

SUMMARY OF THE INVENTION

The control system of the present invention includes fiber feeding apparatus for delivering a batt of fiber to a card, such fiber feeding apparatus being provided with an oscillating plate which acts on the accumulated fiber therein to densify such fiber, and signal generating means is provided for sensing a function of the quantity of fiber in the batt delivered to the card, preferably the weight of such batt, and for generating a signal that is proportional to such sensed quantity of fiber. This signal is received by control means which varies the speed of oscillating movement of the aforesaid plate in a predetermined ratio to the quantity of fiber sensed by the signal generating means.

In one embodiment, of the present invention, the oscillating plate is driven by a motor, such motor being driven by a first control means in a predetermined ratio to the operating speed of the card, and the signal generated in response to the sensed quantity of fiber in the batt is utilized in a second control means which overrides the first control means to change the speed of the oscillating plate motor and thereby vary the ratio between the operating speed of the card and the speed of the oscillating plate motor.

Additionally, the fiber feeding apparatus of the present invention is provided with a rotating opening feed roll that delivers fiber to a column in which the fiber is densified, and this opening feed roll is also directly driven at a speed having a predetermined ratio to the operating speed of the card. The fiber feeding apparatus is also provided with means, such as a photoelectric cell, for sensing the level of the accumulated fiber in the fiber feeding apparatus and for generating a signal in response to predetermined changes in such level, and this signal is utilized in a control system to selectively override the direct drive between the card and the opening feed roller to change the speed of the latter and thereby vary the ratio between the operating speed of the card and the speed of the opening feed roll.

Thus, in the foregoing embodiment of the present invention, the oscillating plate and the opening feed roll of the fiber feeding apparatus are driven directly in response to the operating speed of the card so that the batt delivered to the card by the fiber feeding apparatus is controlled by the operating speed of the card. Moreover, the weight of the batt being delivered to the card is sensed and a signal is generated to reflect variations in such weight. This signal is used to override the direct drive between the card and the oscillating plate of the fiber feeding apparatus and to vary the speed of the latter elements so as to change the density of the batt in response to sensed variations thereof before the batt is delivered to the card.

In a further embodiment of the present invention, the operating speed of the card may be sensed only in terms of whether the card in "on" (e.g. operating) or "off" (e.g. not operating). In this embodiment, a first signal is generated when the card is on and this signal is utilized to actuate the motors for the oscillating plate and for the opening feed roll of the fiber feeding apparatus at a predetermined operating speed, and the aforesaid signal generated in response to the sensed quantity of fiber in the batt is utilized to vary the operating speed of such motors and the oscillating plate and opening feed roll driven thereby. When the card is not operating, a second signal is generated which stops the operation of the motors for the opening feed roll and the oscillating plate.

It will be apparent that any variations in the density of the batt being delivered to the card are corrected almost immediately by varying the operation of the fiber feeding apparatus which is forming the batt, and this immediate correction provides substantially improved results as compared with conventional autoleveling where the operation of the card, rather than the fiber feeding apparatus, is varied in response to sensed density variations in the batt.

BRIEF DESCRIPTION OF THE DRAWINGS

FIG. 1 is a general layout view illustrating the relative positions of a fiber feeding apparatus and a card;

FIG. 2 is a diagrammatic side elevational view of typical fiber feeding apparatus utilized in conjunction with the present invention;

FIG. 3 is a schematic view of one control system of the present invention;

FIG. 4 is a chart illustrating the control features of the present invention.

DESCRIPTION OF THE PREFERRED EMBODIMENT

Figure 5:
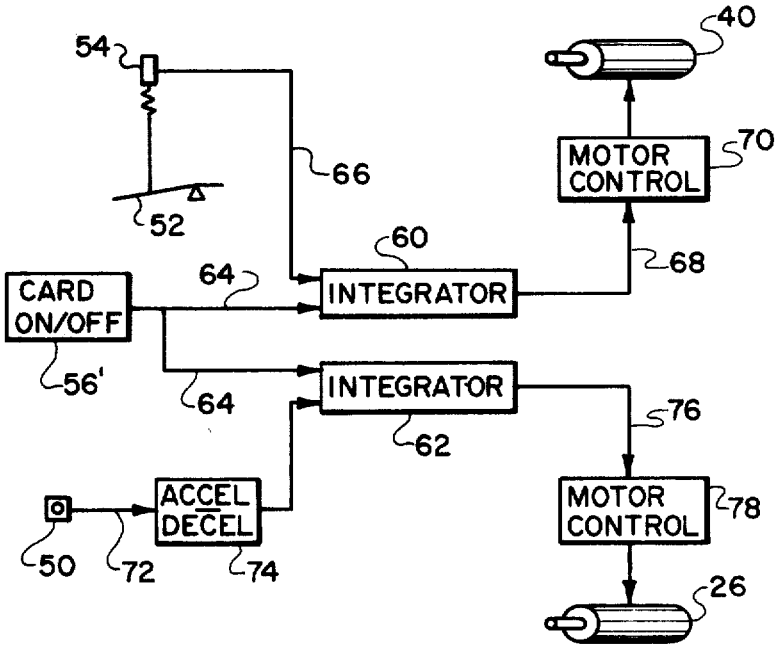
FIG. 5 is a schematic view of an alternate control system of the present invention.

Looking now in greater detail at the accompanying drawings, FIG. 1 illustrates a conventional layout of equipment associated with the carding of fibers including a fiber feeding device such as a chute feed 10 which, as will be explained in greater detail below, receives fiber and forms it into a batt, and a conventional card 12 that receives the batt from the chute feed 10 and processes the fiber to form a sliver 14 that is fed to a sliver can 16, the card 12 including a main cylinder 18 and a doffer 20 as shown in FIG. 1.

The chute feed 10 is shown diagrammatically in greater detail in FIG. 2, and is essentially of the same construction as the apparatus described in commonly owned copending U.S. patent application Ser. No. 207,394, filed Nov. 17, 1980, by Alex J. Keller and Akiva Pinto, now abandoned, to which reference may be made for a detailed description of the construction and operation of the chute feed 10. For purposes of understanding the present invention, it is only necessary to summarize the operation of the chute feed 10, as follows.

The chute feed 10 includes an inlet duct 22 through which fiber from a source (not shown) is delivered in an air stream to a feed roller 24 rotated by a motor 26. The feed roller 24 delivers the fiber to an opening roller 28 rotated by a motor 29 to open the fiber and deliver the fiber to a vertical column in the form of a substantially enclosed chute 30. The chute 30 includes a fixed wall 32, and an opposite wall that is made up of a fixed wall portion 34 having perforations 36 formed therein and a movable wall portion or plate 38 that is pivoted at the upper end thereof for oscillating movement toward and away from the fixed wall 32, such oscillating movement being obtained by a drive motor 40 and an eccentric linkage 42 connected to the bottom end of the oscillating plate 38. It will be apparent that as the fiber accumulates in the column or chute 30, the oscillation of the plate 38 will act, together with the fixed wall 32, to densify the fiber therebetween, and that this densification will be increased or decreased as the speed of oscillation of the plate 38 increases and decreases, respectively. A pair of delivery rollers 44 and 46 are disposed at the bottom of the chute 30 to deliver fiber from the chute 30 in the form of a batt 48 to the card 12 shown in FIG. 1.

The chute feed 10 also includes a photoelectric cell or electric eye 50 that is associated with the chute 30 at a location near the upper end thereof. The photoelectric cell 50 operates in a conventional manner to generate a signal when the level of the fiber is interposed in the straight line path of the electric eye, and another signal when such fiber level is beneath the level of the electric eye 50. Thus, in effect, the electric eye 50 generates a first signal indicating that the fiber level is at or above a predetermined level in the chute 30 as determined by the location of the electric eye 50, and generates a second signal indicating that the fiber level is below such predetermined level. These signals are utilized to control the operation of the feed roller 24 in a manner to be explained in greater detail below.

In accordance with the present invention, a function of the quantity of the fiber in the batt 48 leaving the chute feed 10 is sensed before such batt 48 is received by the card 12. In the preferred embodiment of the present invention, the weight of a predetermined portion of such batt 48 is sensed as shown diagrammatically in FIG. 2 where the batt 48 is shown as moving across a pivoted surface 52 to which is connected a conventional strain gauge 54 which acts to generate a signal that is proportional to the weight of the batt 48 being sensed. Because the weight of the batt 48 is a function of the quantity of fiber in the batt, this signal generated by the strain gauge 54, generally reflects not only the weight of the batt 48 but also the quantity of fiber contained in such batt and the density of the batt, and it is to be expressly understood that the weight and density of the batt 48 are both functions of the quantity of fibers contained therein so that either the weight or density of the batt 48 could be sensed in generating a signal utilized in the control system of the present invention.

As discussed above, most conventional autolevelers include an electronic drive by which the speed of the doffer of the card and the card input feed rollers are driven together at a predetermined speed ratio, such ratio being adjusted by the signal generated in response to the sensing of the density of the sliver leaving the card. A typical electronic drive of this type includes a conventional digital pick-up which senses the speed of rotation of the doffer gear, and the signal generated by this digital pickup is utilized to control the speed of the card input feed rollers in proportion to the speed of the doffer gear.

As illustrated diagrammatically in FIG. 3, one embodiment of the control system of the present invention also includes a conventional digital pick-up 56 which senses the speed of the doffer gear 58 of the card 12 and generates a signal that reflects the operating speed of the card 12. This signal is utilized to drive the input feed roll of the card in the same manner as in conventional cards, but in the present invention this signal is also transmitted simultaneously to a first integrator circuit 60 and a second integrator circuit 62 as indicated by lead lines 64 and 64' in FIG. 3, such integration circuits being entirely conventional electronic circuits which function to integrate two separate input signals and produce a single output signal having a predetermined relationship to the input signals.

The first integrator 60, in addition to receiving a signal from the digital pick-up 56, also receives a signal through lead line 66 from the above-described electronic strain gauge 54 located at the outlet end of the chute feed 10, and the output signal from the first integrate 60 is transmitted through lead line 68 to a motor control 70 which regulate the speed of the drive motor 40 that oscillates the plate 38 (see FIG. 2) in the chute feed 10. The control circuit through the first integrator 60 acts to sense the operating speed of the card through the digital pickup 56 and to then act as a primary drive for the motor 40 so as to operate the motor 40 at a speed having a predetermined ratio to the speed of the card whereby as the speed of the card increases to generate a greater demand for fiber the speed of the oscillation of the plate 38 is proportionally increased to provide the desired densification of the increased quantity of fiber flowing through the chute feed 10. Additionally, the control circuit through integrate 60 acts to selectively override the primary and proportional drive of the motor 40 by varying the ratio between the card speed and the speed of the motor 40 in response to variations in the weight of the fiber in batt 48 as sensed by the strain gauge 54. More specifically, as the speed of the card 12 changes, the oscillating speed of the plate 38 will be changed proportionally, and the ratio between these speeds will remain constant until an overriding signal is received from strain gauge 54. This overriding signal will act to vary slightly the speed ratio between the card 12 and movable wall portion 38 to cause a slight relative increase in the speed of the movable wall portion 38 when the sensed weight of the batt 48 is below a predetermined norm, and to cause a slight relative decrease in the oscillating speed of the plate 38 when the sensed weight of the batt 48 is above such norm.

The effect of this relationship is shown graphically in the top and bottom lines in FIG. 4. The solid line A at the top of FIG. 4 represents the speed of the card 12 as determined by sensing the speed of the doffer gear 58, it being noted that in normal operation the card 12 starts at zero speed and first accelerates to a "slow" speed indicated by segment a' of line A while the operator puts up the end of the fiber, and then accelerates to the normal operating speed of the card indicated by segment a" of line A. The solid line B in FIG. 4 represents the primary proportional speed at which the plate 38 is oscillated by its motor 40, it being noted that this oscillating speed has a predetermined ratio to the card speed as indicated by the fact that lines A and B are parallel. Additionally, the override imposed on the oscillating speed of the plate 38 by the signal from the strain gauge 54 is represented in FIG. 4 by the dotted line O, it being noted that this speed override follows an unpredicable pattern on both sides of line B as the sensed weight of the batt 48 varies above and below the aforesaid predetermined norm.

Turning to the control circuit through the second integrator 62 in FIG. 3, the signal from the digital pick-up 56 is transmitted through lead line 64' to the second integrator 62. Additionally, the above-described signal from the photoelectric cell 50 is transmitted through lead line 72 to an accelerator/decelerator circuit 74 which senses this signal and, depending upon whether the level of the fiber in the chute 30 is above or below the level of the photoelectric cell 50, generates either an "accelerating" or "decelerating" overriding signal that is transmitted through line 76 to the second integrator 62. The second integrator produces an integrated output signal in the same manner as that described above in connection with the first integrator 60, and this output signal is transmitted through line 76 to a motor control 78 which regulates the speed of the drive motor 26 for the feed roller 24 (see FIG. 2) of the chute feed 10. The signal received from the digital pick-up 56 is utilized as the primary signal for operating the feed roll motor 26 at a speed having a predetermined ratio to the speed of the card 12 as sensed by the digital pick-up 56 whereby the speed of the feed roll 24, and the quantity of fiber delivered thereby to the chute 30, will increase and decrease proportionally as the speed of the operating card 12 increases and decreases. Additionally, the control circuit through the second integrator 62 acts to selectively override the primary and proportional drive of the feed roll motor 26 by varying the ratio between the card speed and feed roll speed in response to variations in the level of the fiber in the chute 30 as sensed by the photoelectric cell 50. More specifically, if the sensed fiber level is below the predetermined norm, the accelerator/decelerator circuit 74 will generate an "accelerating" signal that is transmitted to the second integrator 62 to vary the card speed/feed roll speed ratio slightly by increasing the relative speed of the feed roll 24 to cause more fiber to be fed to the chute 30. Likewise, if the level of fiber is above the predetermined norm, the relative speed of the feed roll 24 will be reduced to cause less fiber to be fed to the chute 30.

The aforesaid control of the speed of the feed roll 24 is also shown graphically in FIG. 4 where the solid line C represents the primary proportional speed of the feed roll 24, and dotted line O' represents the overriding control imposed on the feed roll by the photoelectric cell 50. Again, it will be noted that solid line C is parallel to the solid line A representing the operating speed of the card 12, and that the override indicating line O' follows an unpredicable pattern above and below the line C as the level of the fiber in the chute 30 varies.

Another embodiment of the control system of the present invention is illustrated diagrammatically in FIG. 5 which is similar to FIG. 4 except that the digital pick-up 56 in FIG. 4 is replaced by a signal generating unit 56' which generates a first signal when the card 12 is operating (e.g. "on") and a second signal when the card 12 is not operating (e.g. "off"), and these signals are received by the integrator circuits 60 and 62. In this embodiment, the integrator circuits 60 and 62 do not cause the motor controls 70 and 78 to rotate the motors 40 and 26, respectively, at speeds having a predetermined ratio to the speed of the card 12, but, rather, the integrator circuits 60 and 62 cause the motor controls 70 and 78 to rotate the motors 40 and 26, respectively, at a predetermined speed when the card 12 is operating as indicated by the first or "on" signal received from the signal generating unit 56' and to stop rotation of the motors 40 and 26 when the card 12 is not operating as indicated by the second or "off" signal received from the signal generating unit 56'. The speeds of the motors 40 and 26 are then varied from such predetermined speeds in response to the overriding control imposed thereon by the strain gauge 54 and the electric eye 50 in the same manner as that described above in connection with FIG. 3.

By virtue of the unique control system of the present invention, a number of significant advantages are obtained which tend to significantly increase the uniformity of the sliver produced by a card while decreasing the yarn count variations in such sliver.

Initially, it is to be noted that the speed of both the feed roll 24 and the oscillating plate 38 are controlled primarily in direct response to the operating speed of the card 12, rather than independently of the card 12, so that the batt 48 being formed by the chute feed 10 and delivered to the card 12 reflects more accurately the demands of the card 12. For example, in the embodiment illustrated in FIG. 3, when the card 12 is operating at its slow speed to permit the putting up of the end, the fiber fed to the chute 30 in the chute feed 10 is reduced proportionally and the oscillations of the movable wall portion 38 are likewise reduced so that the small amount of fiber passing through the chute feed 12 will not be excessively densified, all of which serves to produce a more uniform batt 48 being delivered from the chute feed 10 to the card 12.

Additionally, in accordance with a particularly significant feature of the present invention, the batt 48 is sensed prior to its being delivered to the card to determine a function of the quantity of the fiber in such batt, and the signal generated by such sensing is immediately utilized to correct any variation in the density of the batt from a predetermined desired norm. Thus, if the weight of the batt 48 sensed by the strain gauge 54 indicates that the density of the batt is too great, the signal generated by the strain gauge 54 immediately causes the speed of oscillation of the plate 38 to be proportionally slowed whereby the density of the batt 48 is immediately reduced. If, on the other hand, the sensing of the batt 48 indicates a lesser density than is desired, the oscillating speed of the plate 38 is immediately increased in proportion to the variation between the sensed batt density and the desired batt density. Since the strain gauge 54 is disposed substantially at the delivery end of the chute feed 10, it will be apparent that the correcting effect imposed immediately on the movable wall portion 38 will act to correct immediately any variation in the batt density at almost the same point where the variation is sensed. As a result, the density of the batt 48 that is delivered to the card will be extremely uniform, and the sliver produced by the card 12 from such batt will likewise have extremely uniform density characteristics. This is to be contrasted with typical, conventional autoleveling where the density of the fiber at the output end of the card is sensed, and the correction to the batt is made at the input end of the card by varying the speed of the card feed rolls to vary the amount of fiber fed to the card. Such remote correction of the fiber fed to the card not only fails to correct the density of the substantial amount of the fiber which is already on the main cylinder at the time the sliver density if sensed, it also may result in corrections being made which may not be needed in view of the remoteness between the point at which the density is sensed and the point at which the density correction is imposed on the fiber.

The batt density correcting feature of the present invention also represents a marked improvement over known autoleveling systems, described above, which sense the weight of the batt being delivered by the chute and changes the proportional speed of the input feed rolls of the card. This change in the proportional speed of the doffer and the input feed rolls can adversely affect the degree of carding by the card and/or can undesirably alter the degree of parallelism of the fibers being carded. This is to be contrasted with the present invention where the proportional speed of the doffer and the input feed rolls of the card always remains constant, and the density of the batt is corrected by regulating the chute feed which forms the batt.

Finally, the control system of the present invention serves to reduce short-term variations in the sliver which has heretofore been caused by the chute feed being operated independently of the card. For example, when doffing of the card takes place in conventional carding systems, the speed of the card is reduced to its slow speed to permit the operator to put the end up as he changes sliver cans, but the speed of operation of the independently controlled chute feed is not automatically reduced at the same time. As a result, the weight or density of the batt being produced by the chute feed will normally increase because of the reduced demand of the card operating at its slow speed. By contrast, the control system of the present invention results in the speed of the feed roll 24 and the oscillating plate 38 being reduced as soon as the speed of the card is reduced, and the speed of the feed roll 24 is also varied in accordance with the level of the fiber which has accumulated in the chute feed to provide a smooth regulation of the fiber being fed to the chute feed which in turn, provides an unusual degree of evenness to the batt produced by the chute feed.

The present invention has been described in detail above for purposes of illustration only and is not intended to be limited by this description or otherwise to exclude any variation or equivalent arrangement that would be apparent from, or reasonably suggested by the foregoing disclosure to the skill of the art.

We claim:

1. A control system for use in textile processing equipment that includes fiber feeding means for delivering a batt of fiber to carding means, said fiber feed means including an oscillating plate acting on the fiber in said fiber feeding means to densify said fiber, said control system comprising:

(a) signal generating means for sensing a function of the quantity of fiber in said batt delivered by said fiber feeding means to said carding means and for generating a signal that is proportional to said sensed quantity of fiber; and (b) control means receiving said generated signal and varying the movement of said oscillating plate in said fiber feeding means in a predetermined ratio to the quantity of fiber sensed by said signal generating means.

2. A control system for use in textile processing equipment as defined in claim 1 and further characterized in that said signal generating means senses the weight of a predetermined portion of said batt.

3. A control system for use in textile processing equipment as defined in claim 2 and further characterized in that said signal generating means includes a surface portion across which said batt moves as it is delivered from said fiber feeding means, and includes strain gauge means for sensing the weight of batt on said surface portion.

4. A control system for use in textile processing equipment as defined in claim 1 and further characterized in that said oscillating plate is operated by motor means, and in that said control means varies the speed of said motor means to thereby vary the speed of oscillation of said plate.

5. A control system for use in textile processing equipment as defined in claim 1 and further characterized in that said oscillating plate is operated by motor means, and in that said control means operates said motor means in response to a signal indicating that said carding means is operating and varies the speed of said motor means in response to said signal received from said signal generating means.

6. A control system for use in textile processing equipment as defined in claim 4 or claim 5 and further characterized in that said control means increases the speed of said motor means when said signal generated by said signal generating means indicated that said sensed quantity of fiber is below a predetermined norm and decreases the speed of said motor means when said signal indicates that said sensed quantity of fiber is above a predetermined norm.

7. A control system for use in textile processing equipment as defined in claim 1 and further characterized in that said oscillating plate is driven by motor means, in that said motor means is directly driven at a speed having a predetermined ratio to the operating speed of said carding means, and in that said control means selectively overrides said direct drive of said motor means to change the speed of said oscillating plate motor means and thereby vary the ratio between said carding means operating speed and said oscillating plate motor means speed.

8. A control system for use in textile processing equipment that includes fiber feeding means for delivering a batt of fiber to carding means, said fiber feeding means including a column in which fiber is densified, a rotating feed roll for introducing fiber into said column, and means for sensing the quantity of fiber in said column and generating a signal when the said quantity of fiber reaches a predetermined level, said control system comprising:

(a) first control means for sensing an operating condition of said carding means and for rotating said feed roll of said fiber feeding means at a predetermined speed in response to said operating condition of said carding means being sensed; and (b) second control means for receiving said generated signal and selectively overriding said first control means to vary the rotational speed of said feed roll from said predetermined speed in response to receipt of said generated signal.

9. A control system for use in textile processing equipment as defined in claim 8 and further characterized in that said means for sensing the quantity of fiber in said column comprises a photoelectric cell disposed at a predetermined height in said column for generating a first signal when the fiber in said column reaches or exceeds said predetermined height and for generating a second signal when said fiber is beneath said predetermined height, and in that said second control means decreases the speed of said feed roll in response to receipt of said first signal and increases the speed of said feed roll in response to receipt of said second signal.

10. A control system for use in textile processing equipment as defined in claim 8 and further characterized in that said first control means senses the operating speed of said carding means and rotates said feed roll of said fiber feeding means in a predetermined ratio to said carding means operating speed.

11. A control system for use in textile processing equipment as defined in claim 8 and further characterized in that said first control means senses whether said carding means is operating or not operating and rotates said feed roll of said fiber feeding means at a predetermined speed when said carding means is operating.

12. Textile processing apparatus comprising:

(a) carding means including a driven doffer roll;

(b) fiber feeding means for forming a batt of fiber and delivering said batt to said carding means, said fiber feeding means including:

(i) column means for accumulating fiber therein, and including an oscillating plate operated by motor means to densify the said accumulated fiber;

(ii) a rotating feed roll operated by motor means for controlling the quantity of fiber fed to said column means; and (iii) means for sensing the level of said fiber accumulated in said column and generating a signal when said accumulated fiber reaches a predetermined level;

(c) means for sensing a function of the quantity of fiber in said batt delivered by said fiber feeding means to said carding means and for generating a signal in response to said sensed quantity of fiber;

(d) first control means for sensing an operating condition of said carding means, and for operating said feed roll motor means and said reciprocating plate motor means at respective predetermined speeds in response to said operating condition of said carding means being sensed;

(e) second control means for receiving said signal generated by said level sensing means and for selectively overriding said first control means to vary the speed of said feed roll motor from said predetermined speed in response to receipt of said signal generated by said level sensing means; and (f) third control means for receiving said signal generated by said fiber quantity sensing means and for selectively overriding said first control means to change the speed of said oscillating plate motor means in response to said signal received from said fiber quantity sensing means.

13. Textile processing apparatus as defined in claim 12 and further characterized in that said second control means reduces the speed of said feed roll motor means when said fiber level is above said predetermined level and increases the speed of said feed roll motor means when said fiber level is below said predetermined level.

14. Textile processing apparatus as defined in claim 12 and further characterized in that said third control means decreases the speed of said reciprocating plate motor means as the quantity of fiber sensed by said quantity sensing means increases, and increases the speed of said reciprocating plate motor means as the quantity of fiber sensed by said quantity sensing means decreases.

15. Textile processing apparatus as defined in claim 12 and further characterized in that said first control means senses the operating speed of said carding means and operates said feed roll motor means and said reciprocating plate motor means at speeds having a predetermined ratio to said operating speed of said carding means.

16. Textile processing apparatus as defined in claim 12 and further characterized in that said first control means senses whether said carding means is operating or not operating and operates said feed roll motor means and said reciprocating plate motor means at predetermined speeds when said carding means is operating.

* * * * *